US011629460B2

(12) United States Patent
Moynihan et al.

(10) Patent No.: US 11,629,460 B2
(45) Date of Patent: Apr. 18, 2023

(54) FIBER BLEND, METHOD FOR PRODUCING FIBER BLEND, AND PAPERBOARD PRODUCT COMPRISING FIBER BLEND

(71) Applicant: WestRock MWV, LLC, Atlanta, GA (US)

(72) Inventors: Humphrey J. Moynihan, Covington, VA (US); Peter W. Hart, Atlanta, GA (US); Nichole Kilgore, Richmond, VA (US); John D. DeJarnette, Richmond, VA (US)

(73) Assignee: WestRock MWV, LLC, Atlanta, GA (US)

( * ) Notice: Subject to any disclaimer, the term of this patent is extended or adjusted under 35 U.S.C. 154(b) by 232 days.

(21) Appl. No.: 17/183,623

(22) Filed: Feb. 24, 2021

(65) Prior Publication Data

US 2021/0180252 A1 Jun. 17, 2021

Related U.S. Application Data

(62) Division of application No. 16/535,749, filed on Aug. 8, 2019, now Pat. No. 10,961,659.

(60) Provisional application No. 62/717,138, filed on Aug. 10, 2018.

(51) Int. Cl.

| | |
|---|---|
| ***D21H 11/08*** | (2006.01) |
| ***D21D 1/20*** | (2006.01) |
| ***D01B 9/00*** | (2006.01) |
| ***D21H 11/10*** | (2006.01) |

(52) U.S. Cl.
CPC ..... *D21D 1/20* (2013.01); *D01B 9/00* (2013.01); *D21H 11/08* (2013.01); *D21H 11/10* (2013.01)

(58) Field of Classification Search
CPC ..... D21H 11/10; D21H 11/08; D01B 9/00; D21D 1/20; D21D 99/00
USPC ..... 162/100
See application file for complete search history.

(56) References Cited

U.S. PATENT DOCUMENTS

| | | | | |
|---|---|---|---|---|
| 4,609,432 | A * | 9/1986 | Brucato | D21C 9/001 162/149 |
| 6,464,830 | B1 * | 10/2002 | Holz | D21F 11/04 162/149 |
| 2013/0306256 | A1 * | 11/2013 | Hart | D21H 11/08 162/55 |
| 2014/0083634 | A1 * | 3/2014 | Bjoerkqvist | D21D 1/20 162/28 |
| 2015/0211188 | A1 * | 7/2015 | Hart | D21D 5/02 162/123 |
| 2016/0333524 | A1 * | 11/2016 | Pande | D21D 1/20 |
| 2017/0328003 | A1 * | 11/2017 | Retsina | D21C 3/20 |
| 2018/0092397 | A1 * | 4/2018 | Pesendorfer | D21H 27/00 |
| 2018/0313034 | A1 * | 11/2018 | Cowan | D21G 9/0018 |

* cited by examiner

*Primary Examiner* — Mark Halpern
(74) *Attorney, Agent, or Firm* — Walters & Wasylyna LLC

(57) ABSTRACT

A fiber blend includes a first amount of wood pulp fibers refined in an amount of at least about 150 kWh per metric ton of gross refining energy, and a second amount of wood pulp fibers refined in an amount of at most about 10 kWh per metric ton of gross refining energy.

20 Claims, 9 Drawing Sheets

FIBER BLEND, METHOD FOR PRODUCING FIBER BLEND, AND PAPERBOARD PRODUCT COMPRISING FIBER BLEND

This application is a divisional of U.S. Ser. No. 16/535,749 filed on Aug. 8, 2019, which claims priority from U.S. Ser. No. 62/717,138 filed on Aug. 10, 2018. The entire contents of U.S. Ser. Nos. 16/535,749 and 62/717,138 are incorporated herein by reference.

FIELD

The present application relates to the field of fiber blends, methods for producing fiber blends, and paperboard products comprising fiber blends.

BACKGROUND

Refining is the mechanical treatment of wood pulp fibers to impart to the fibers the appropriate characteristics for papermaking.

Wood pulp fibers are typically refined in a range of 20 to 120 kWh/ton prior to incorporation into a paperboard product. However, those skilled in the art continue with research and development in the field of fiber blends, methods for producing fiber blends, and paperboard products comprising fiber blends.

SUMMARY

In one embodiment, a fiber blend includes a first amount of wood pulp fibers refined in an amount of at least about 150 kWh per metric ton of gross refining energy, and a second amount of wood pulp fibers refined in an amount of at most about 10 kWh per metric ton of gross refining energy.

In another embodiment, a method for producing a fiber blend includes refining a first stream of wood pulp fibers in an amount of at least about 150 kWh per metric ton of gross refining energy, refining a second stream of wood pulp fibers in an amount of at most about 10 kWh per metric ton of gross refining energy, and blending the first stream of wood pulp fibers and the second stream of wood pulp fibers.

In yet another embodiment, a paperboard product includes a fiber blend, the fiber blend including a first amount of wood pulp fibers refined in an amount of at least about 150 kWh per metric ton of gross refining energy, and a second amount of wood pulp fibers refined in an amount of at most about 10 kWh per metric ton of gross refining energy.

Other embodiments of the disclosed fiber blend, method for producing a fiber blend, and paperboard product including a fiber blend will become apparent from the following detailed description, the accompanying drawings and the appended claims.

DETAILED DESCRIPTION

Figure 1:
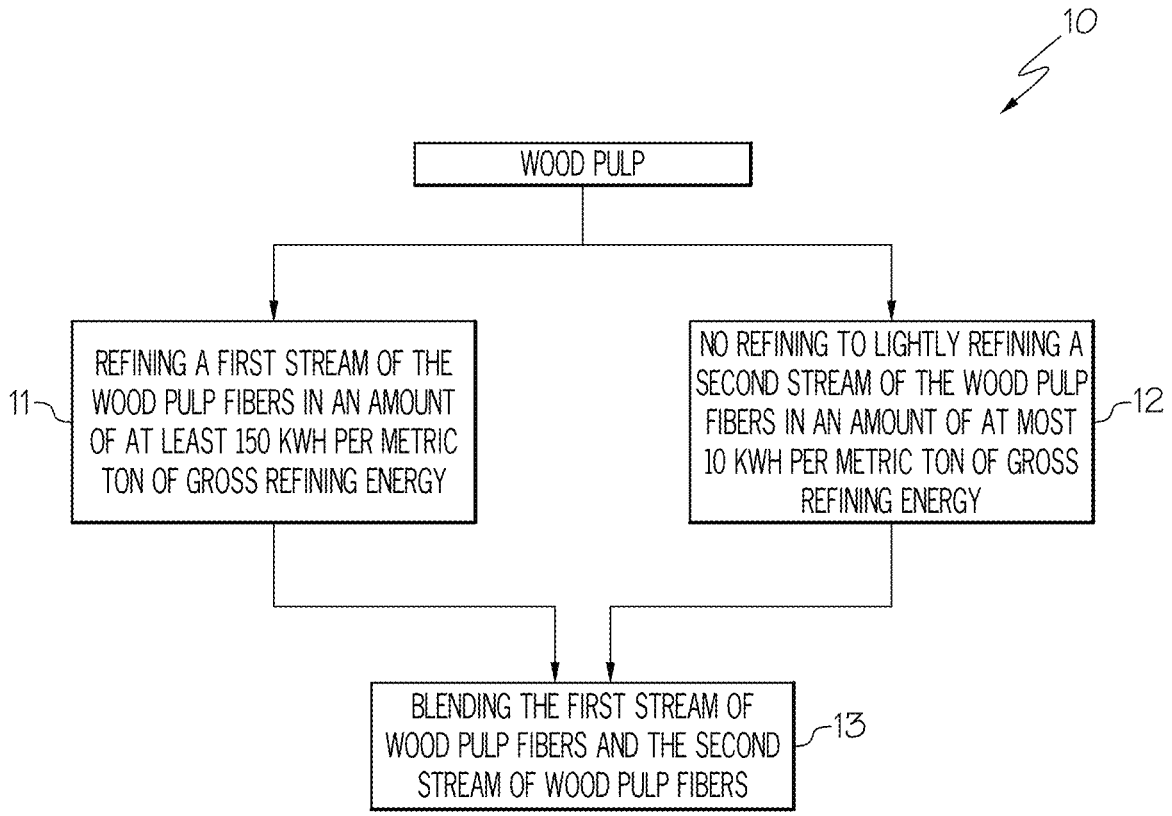
FIG. 1 is a flow chart representing a method for producing a fiber blend according to an embodiment of the present description.

Paperboard strength properties depend upon two distinct factors: the intrinsic fiber strength and the number and strength of bonds formed in the sheet between fibers, i.e., the relative bonded area. When paperboard is subjected to an increasing force, eventually either the fibers rupture or the bonds between fibers fail. Rarely would the two modes of failure occur at the same time. For paperboard, bond failure is typically the dominant strength limitation for tensile and out of plane forces. Compression failures typically result from fiber damage and fibrous network disruption, not bond failure.

Refining improves fibrous network (e.g., sheet) strength by damaging the fibers to enhance the area available for bonding and by driving water into the fibers to hydrate the fibers, making the fibers more flexible. A minimal level of refining is necessary to form a cohesive sheet structure that retains its integrity when dried. Higher levels of refining result in well hydrated fibers with an extensive amount of microfibrils, which enhances bonding and, thus, improves paperboard strength properties. However, these fibers tend to pack more uniformly when forming fibrous networks, which results in sheet structures with higher densities at the higher levels of refining.

There is a desire to provide a paperboard product at significantly lower densities than typically produced by conventional refining but with strength properties that are comparable to paperboard produced by conventional refining.

Conventionally, heavy refining of wood pulp fibers is avoided because excessive refining results in extensive fiber cutting and a reduction in several key physical properties in the resulting paperboard, including reduced bulk (i.e., increased density).

In comparison, the present description involves extensive refining only a portion of the pulp furnish to optimize bond development while leaving a remainder of the fibers in the furnish substantially unrefined and undamaged. This allows formation of a cohesive sheet structure at a lower density than provided with conventional technology. This selective refining results in minimal fiber length reduction (cutting) of a portion of the fibers.

According to a first embodiment of the present description, there is a fiber blend that includes a first amount of wood pulp fibers refined in an amount of at least about 150 kWh per metric ton of gross refining energy, and a second amount of wood pulp fibers refined in an amount of at most about 10 kWh per metric ton of gross refining energy. It will be understood that the second amount of wood pulp fibers may remain unrefined, in which case, the unrefined second amount of wood pulp fibers are refined in an amount of about 0 kWh per metric ton of gross refining energy.

In an aspect of the present description, first amount of wood pulp fibers is preferably refined in a range of about 150 to about 2000 kWh per metric ton of gross refining energy, more preferably in a range of about 200 to about 1500 kWh per metric ton of gross refining energy, even more preferably in a range of about 200 to about 1000 kWh per metric ton of gross refining energy.

In an aspect of the present invention, the second amount of wood pulp fibers is preferably refined in an amount of at most about 5 kWh per metric ton of gross refining energy, more preferably in an amount of at most about 2 kWh per metric ton of gross refining energy, even more preferably the second amount of wood pulp fibers remain unrefined.

The quantification of gross refining energy is a conventional technique for characterization of refined wood pulp fibers. It will be understood that the first amount of wood pulp fibers are characterized by extensive fiber damage and fiber cutting as a result of having undergone the extensive refining. It will be understood that the second amount of wood pulp fibers are characterized as having little or no damage and little or fiber cutting as a result of having undergone little or no refining.

The fiber blend of the present description is a mixture of the first amount of wood pulp fibers that are characterized by extensive fiber damage and extensive fiber cutting with the second amount of wood pulp fibers that are characterized as having little or no damage and little or no fiber cutting.

In an aspect of the present description, a minimum percentage of the first amount of wood pulp fibers is controlled to provide sufficient bond development. Preferably, the first amount of wood pulp fibers are present in an amount of at least about 5% by volume of the total volume of the fiber blend. More preferably, the first amount of wood pulp fibers are present in an amount of at least about 10% by volume of the total volume of the fiber blend.

In another aspect of the present description, a maximum percentage of the first amount of wood pulp fibers is controlled to avoid a reduction in physical properties including reduced bulk (increased density). Preferably, the first amount of wood pulp fibers are present in an amount of at most about 40% by volume of the total volume of the fiber blend. More preferably, the first amount of wood pulp fibers are present in an amount of at most about 30% by volume of the total volume of the fiber blend.

In an aspect of the present description, a minimum percentage of the second amount of wood pulp fibers is controlled to provide high intrinsic fiber strength. Preferably, the second amount of wood pulp fibers are present in an amount of at least about 60% by volume of the total volume of the fiber blend. More preferably, the second amount of wood pulp fibers are present in an amount of at least about 70% by volume of the total volume of the fiber blend.

In an aspect of the present description, a maximum percentage of the second amount of wood pulp fibers is controlled to avoid deterioration of bonds formed between fibers. Preferably, the second amount of wood pulp fibers are present in an amount of at most about 95% by volume of the total volume of the fiber blend. More preferably, the second amount of wood pulp fibers are present in an amount of at most about 90% by volume of the total volume of the fiber blend.

In an aspect of the present description, the fiber blend may further include additional fiber components, such as conventionally refined wood pulp fibers. Preferably, the percentage of additional components is at most about 30% by volume of the total volume of the fiber blend. More preferably, the percentage of additional components is at most about 20% by volume of the total volume of the fiber blend. Even more preferably, the percentage of additional components is at most about 10% by volume of the total volume of the fiber blend. Even more preferably, the percentage of additional components is at most about 5% by volume of the total volume of the fiber blend. In one aspect, fiber blend consists of the first amount of wood pulp fibers refined in an amount of at least about 150 kWh per metric ton of gross refining energy and the second amount of wood pulp fibers refined in an amount of at most about 10 kWh per metric ton of gross refining energy.

The first amount of wood pulp fibers and the second amount of wood pulp fibers can include any combination of hardwood fibers, softwood fibers, and recycled fibers. The first amount of wood pulp fibers and the second amount of wood pulp fibers can include any combination of bleached wood pulp fibers and unbleached wood pulp fibers. In a preferred aspect, the first amount of wood pulp fibers and the second amount of wood pulp fibers are unbleached wood pulp fibers.

In an example, the first and second amount of wood pulp fibers may include hardwood fibers. In another example, the first and second amount of wood pulp fibers may include softwood fibers. In yet another example, the first and second amount of wood pulp fibers may include recycled fibers. In additional examples, the first amount of wood pulp fibers may include one of hardwood fibers, softwood fibers, and recycled fibers, and the second amount of wood pulp fibers may include another one of hardwood fibers, softwood fibers, and recycled fibers. In yet additional examples, the first and/or the second amount of wood pulp fibers may include blends of hardwood fibers, softwood fibers, and/or recycled fibers.

The wood pulp fibers may be produced by any suitable method. For example, the wood pulp fibers may be produced in a pulp mill according to the following steps.

Next, a fiber source may be pulped by a chemical pulping method. The chemical pulping method may include any pulping method that includes a chemical pulping effect, such fully chemical processes (e.g. sulfite or kraft processes) or semi-chemical processes (e.g., chemithermomechanical pulping). The function of the pulping is to break down the bulk structure of the fiber source.

Then, the resulting pulp may be subjected to a fiberizing process. The fiberizing process is not limited and may include any suitable fiberizing process that functions to separate groups of fibers into individual fibers.

Third, the resulting fibers may be washed. Washing is not limited and may include any suitable washing process that separates the individual fibers from byproducts of the fiber source.

After washing, the wood fibers are typically moved to a paper mill for subsequent processes, including refining.

The refining of the present description is not limited to any particular type of refining. In an example, the refining may be performed by continuous disk refiners, which are rotating disks having serrated or otherwise contoured surfaces. An action of the rotating disks damages the fibers. A space between the disks may be adjusted, depending on the degree of refining desired. The degree of refining, and thus degree of fiber damage, may be characterized by the gross refining energy utilized in the refining process.

After refining, a blending process is employed to produce a fiber blend that includes at least the first amount of highly refined wood pulp fibers as characterized by being refined in an amount of at least about 150 kWh per metric ton of gross refining energy and the second amount of substantially undamaged wood pulp fibers as characterized by being refined in an amount of at most about 10 kWh per metric ton of gross refining energy. The blending process is not limited.

FIG. 1 is a flow chart representing a method for producing a fiber blend according to an embodiment of the present description. As shown in FIG. 1, the method for producing a fiber blend 10 includes, at block 11, refining a first stream of wood pulp fibers in an amount of at least about 150 kWh per metric ton of gross refining energy, at block 12, refining a second stream of wood pulp fibers in an amount of at most about 10 kWh per metric ton of gross refining energy, and, at block 13, blending the first stream of wood pulp fibers and the second stream of wood pulp fibers. The first stream of wood pulp fibers and the second stream of wood pulp fibers can include any combination of bleached wood pulp fibers and unbleached wood pulp fibers. In a preferred aspect, the first stream of wood pulp fibers and the second stream of wood pulp fibers are unbleached wood pulp fibers.

In an aspect, the second stream of wood pulp fibers may remain unrefined.

In another aspect, the method for producing a fiber blend may further include separating a common stream of wood pulp fibers into the first stream of wood pulp fibers and the second stream of wood pulp fibers.

In another aspect, the first stream of wood pulp fibers may be blended in an amount of at least about 5% by volume of the total volume of the blended stream.

In another aspect, the first stream of wood pulp fibers may be blended in an amount of at most about 40% by volume of the total volume of the blended stream.

In another aspect, the second stream of wood pulp fibers may be blended in an amount of at least about 60% by volume of the total volume of the blended stream.

In another aspect, the second stream of wood pulp fibers may be blended in an amount of at most about 95% by volume of the total volume of the blended stream.

After blending, the fiber blend may then be processed into a paperboard product having the desired characteristics accordingly to typical papermaking processes.

In an aspect, the paperboard product preferably has a caliper thickness of about 8 to about 30 point.

In another aspect, the paperboard product is included in at least one of a beverage board, a liner board, and a corrugated medium.

In another aspect, the paperboard product is at least one layer of a multi-ply liner board that comprises a paperboard layer and a paperboard layer.

Table 1 below shows a fiber length comparison between traditionally refined (50 kWh/ton) softwood pulp and highly refined (600 kWh/ton) softwood pulp.

TABLE 1

| Fiber Properties | Fiber Length (mm) | Fiber Width (um) | Fines (<0.2 mm) | | Fines Excluded | | |
|---|---|---|---|---|---|---|---|
| | | | | | Short fiber | Mid fiber | Long fiber |
| Sample ID | Length Weighted | Length Weighted | Length Weighted | Raw Arithmetic | fraction (0.2-0.8 mm) | fraction (0.8-1.8 mm) | fraction (>1.8 mm) |
| 50 kWh/ton | 2.78 | 35.76 | 5.82 | 51% | 26% | 25% | 49% |
| 600 kWh/ton | 2.55 | 34.58 | 6.22 | 50% | 32% | 25% | 43% |

As show in Table 1, a very small increase in fines is noted for the highly refined pulp. For comparison, when making cellulose nanofibrils, the fines content is typically between about 90% and about 95%; while for our highest refined samples, the fines content has been measured as about 6.22% which is very similar to the fines content of conventionally refined pulp at typical levels of refining.

The combination of the first amount of extensively refined wood pulp fibers with the second amount of substantially undamaged wood pulp fibers of the present description creates the needed bonding area with a portion of the fibers through extensive refining, while allowing another portion of fibers to retain their undamaged strength properties.

This selective refining strategy is preferentially performed with low intensity refiner plates but may be performed with medium intensity plates as well. This selective refining may encompass the extensive refining (high energy input) of only a small portion of the furnish of a paper machine. Additionally, optimization may be easier to perform with online pulp property measurement for control of freeness and fibrillation with refining.

In experimental results, approximately equivalent paperboard quality, as measured by modulus, tensile strength, burst, and STFI (a paper property dependent on compressive strength) have been demonstrated at 10 to 15% lower than typical paperboard density, which is highly desirable. Equivalent tear (a paperboard property dependent on fiber length) has been demonstrated at 20% lower paperboard density. These results were seen with paperboard prototypes produced with 10%, 20%, and 30% addition rates of the highly refined pulp to unrefined furnish. The fiber type investigated was unbleached, high yield southern pine, made with the kraft cooking process.

This type of selective refining is expected to provide similar benefit for bleached and recycled fibers as well.

The selective refining process may also provide improvements in pulp drainage, as measured by Canadian Standard Freeness, and in paper drying demand, as measured by water retention value; these improvements would be commercialized as increased production rates on drainage-limited or dryer-limited paper machines.

Figure 2A:
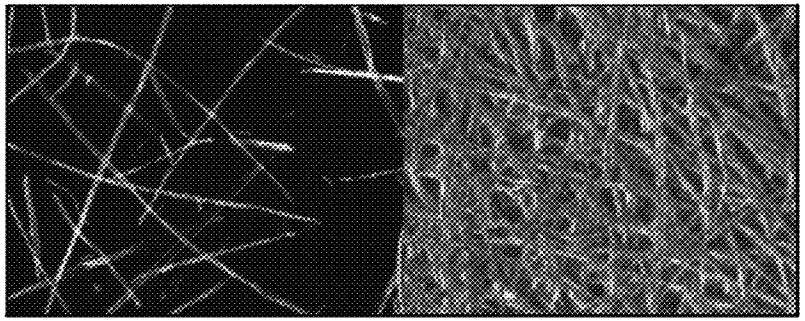
FIGS. 2A to 2D are photomicrographs of traditionally refined unbleached Southern kraft pine compared with unbleached Southern kraft pine that have been refined according to the present description.
Figure 2B:
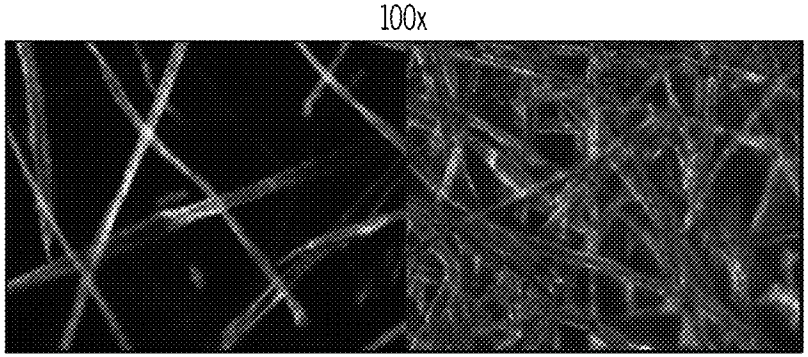
Figure 2C:
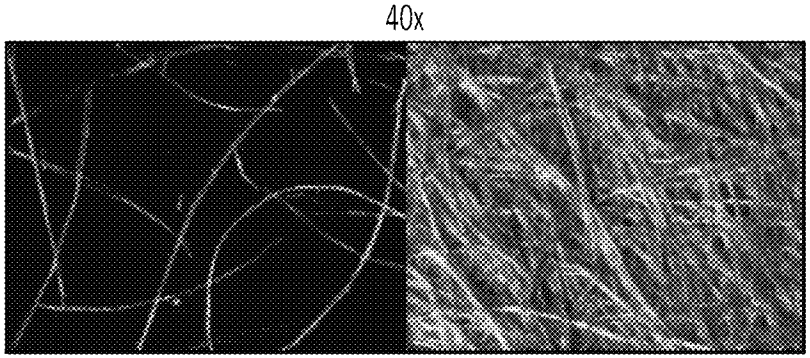
Figure 2D:
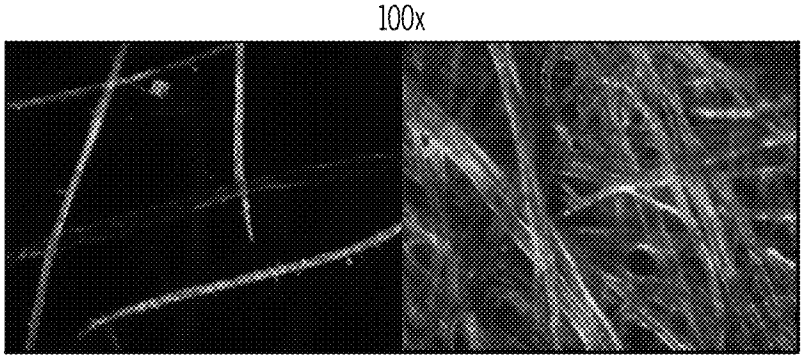

FIGS. 2A to 2D are photomicrographs at 40× and 100× magnification of traditionally refined unbleached Southern kraft pine compared with unbleached Southern kraft pine that have been selectively refined according to the present description. Specifically, FIG. 2A is a photomicrograph at 40× magnification of traditionally refined unbleached Southern kraft pine at about 50 kWh/ton gross refining energy, and FIG. 2B is a photomicrograph at 1000× magnification of traditionally refined unbleached Southern kraft pine at about 50 kWh/ton gross refining energy. FIG. 2C is a photomicrograph at 40× magnification of unbleached Southern kraft pine, in which about 30% of the furnish is refined with about 600 kWh/ton of gross refining energy and about 70% of the furnish is unrefined (i.e. with 0 kWh/ton of gross refining energy), and FIG. 2D is a photomicrograph of the same at 100× magnification.

The differences in fiber and paperboard between the refining of the present description and conventional refining are pictured in FIG. 2, at both 40× and 100× magnification. The individual softwood fibers that have been extensively refined according to the present description have much more fibrillation apparent, which indicates a much higher bonding area available. The paperboard samples produced according to the present description (30% furnish with 600 kWh/ton, 70% furnish with 0 kWh/ton) have a much different appearance, indicative of significant inter-fiber bonding: the sheet appears less porous because of the bonding produced by the increased fibrillation of pulp processed according to the present description. This extensive bonding to the long pine fiber backbone results in a substantially reduced-density fibrous network.

Figure 3:
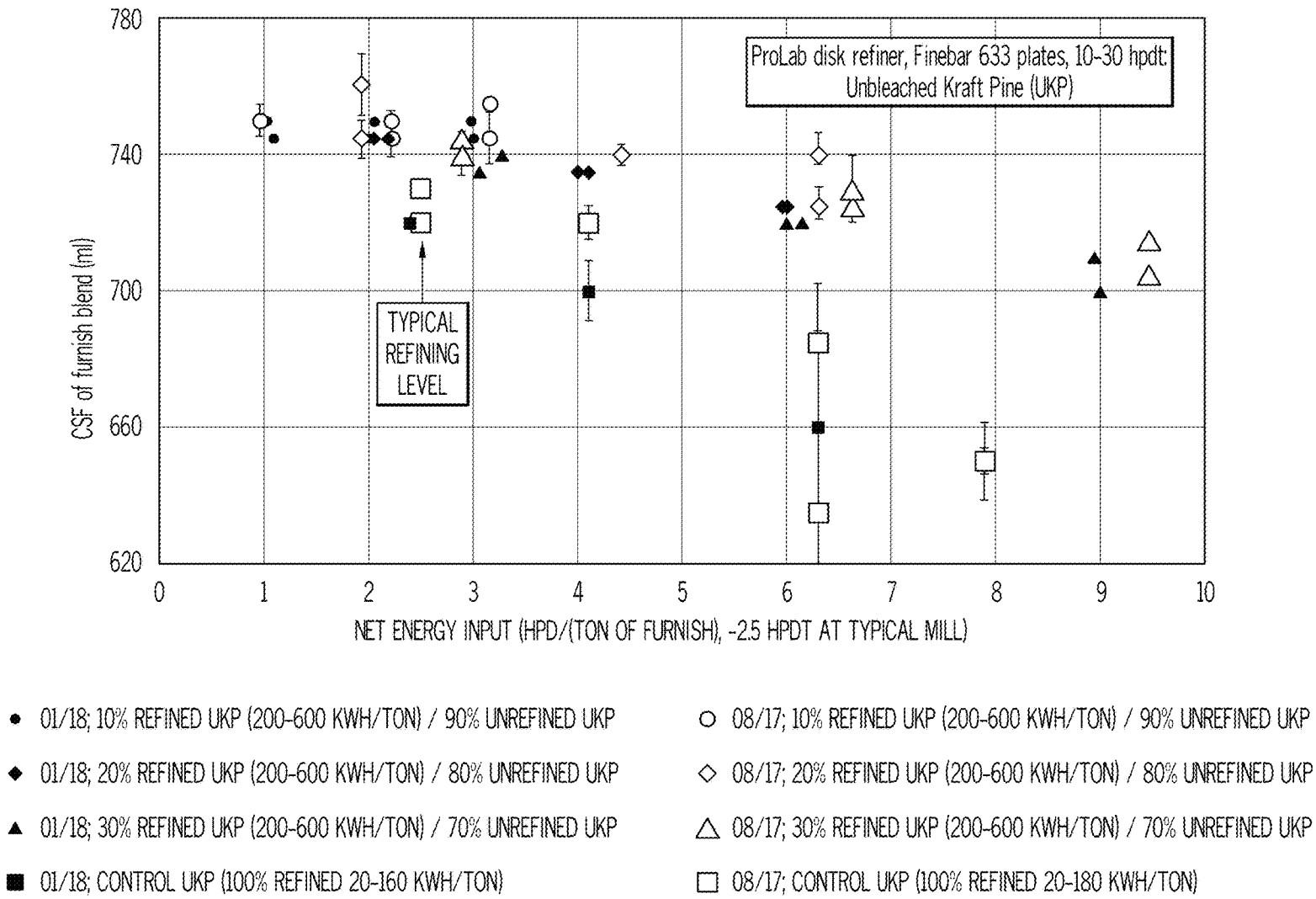
FIG. 3 is a graph showing a comparison of pulp furnish freeness, produced by conventional techniques (control UKP) and produced by the techniques of the present description.
Figure 4:
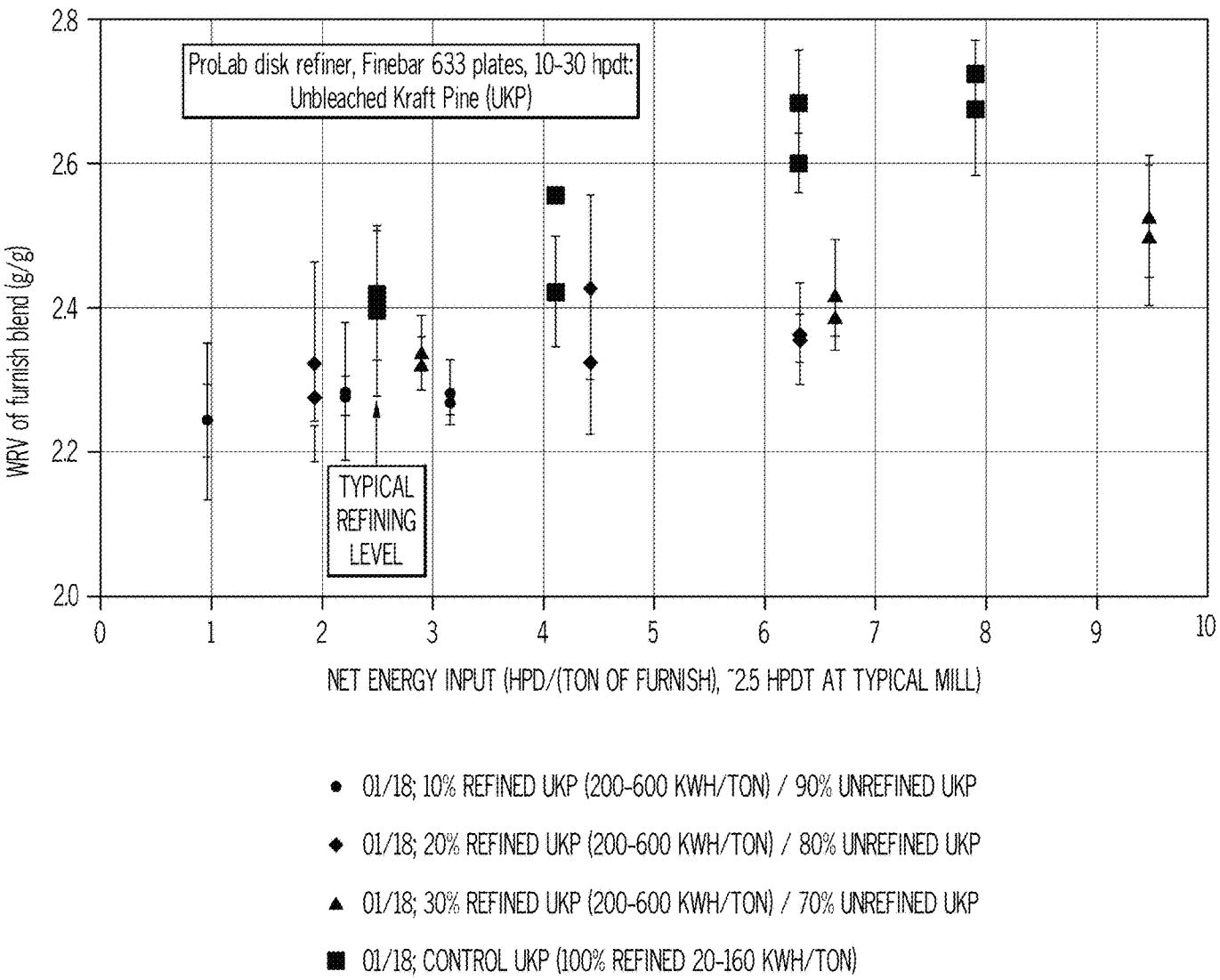
FIG. 4 is a graph showing a comparison of pulp furnish Water Retention Value, produced by conventional techniques (control UKP) and produced by the techniques of the present description.

FIG. 3 shows a comparison of pulp furnish freeness, produced by conventional techniques (control UKP) and produced by the techniques of the present description. FIG. 4 shows a comparison of pulp furnish Water Retention Value, produced by conventional techniques (control UKP) and produced by the techniques of the present description.

As evidenced by FIGS. 3 and 4, the fiber blend of the present description produces the pulp furnish for papermaking with higher freeness and lower water retention value than conventional techniques. The improvement in pulp freeness in seen in FIG. 3, where higher CSF is an indication of better drainage on a paper machine. The improvement in water retention value (WRV) in seen in FIG. 4, where higher WRV is an indication of less steam necessary to dry the sheet on a paper machine.

Figure 5:
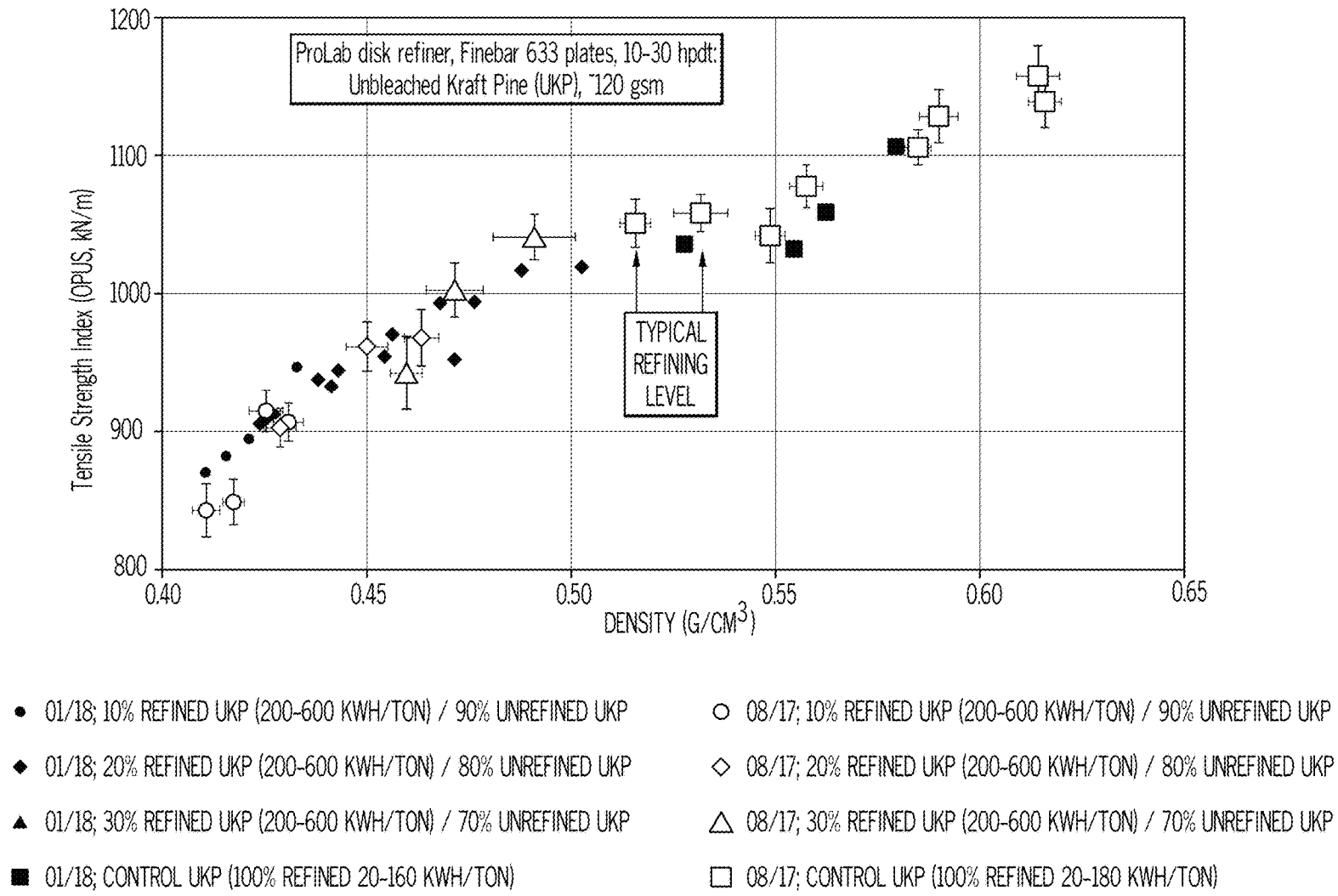
FIG. 5 is a graph showing a comparison of Tensile Strength Index, produced by conventional techniques (control UKP) and produced by the techniques of the present description.

FIG. 5 shows a comparison of Tensile Strength Index, produced by conventional techniques (control UKP) and produced by the techniques of the present description.

As shown in FIG. 5, Equivalent Tensile Strength Index (Tensile Strength normalized by basis weight) has been achieved at about 10% less density, where the techniques of the present description resulted in a density of about 0.45-0.47 g/cm$^3$ with tensile strength within about 10% of conventionally refined paper board (at a density about 0.52 g/cm$^3$).

Figure 6:
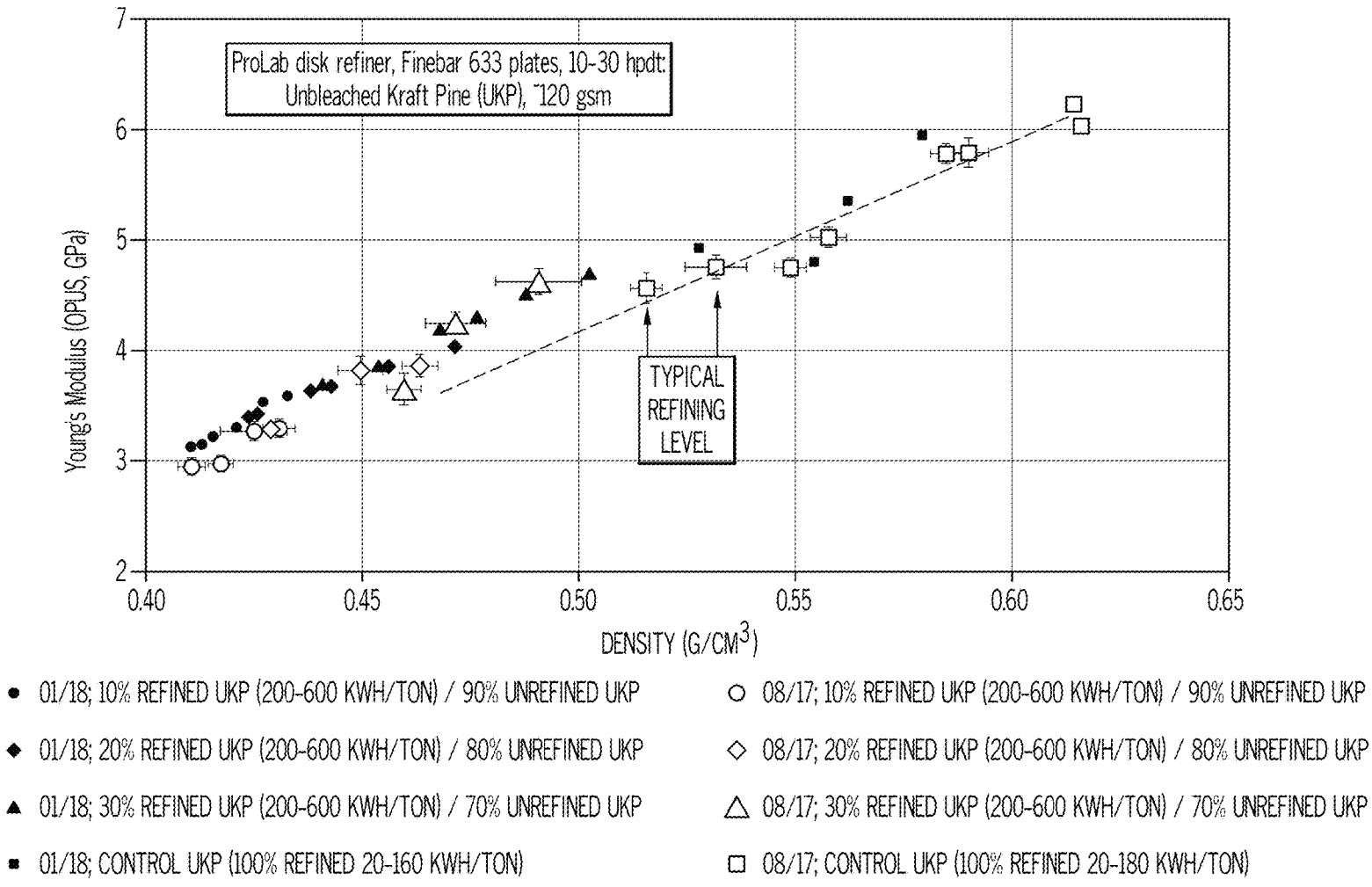
FIG. 6 is a graph showing a comparison of Young's Modulus, produced by conventional techniques (control UKP) and produced by the techniques of the present description.

FIG. 6 shows a comparison of Young's Modulus, produced by conventional techniques (control UKP) and produced by the techniques of the present description.

As shown by FIG. 6, Equivalent Young's Modulus has been achieved at about 10% less density, where techniques of the present description resulted in a density of about 0.45-0.47 g/cm$^3$ with Young's Modulus within about 10% of conventionally refined paper board (at a density about 0.52 g/cm$^3$).

Figure 7:
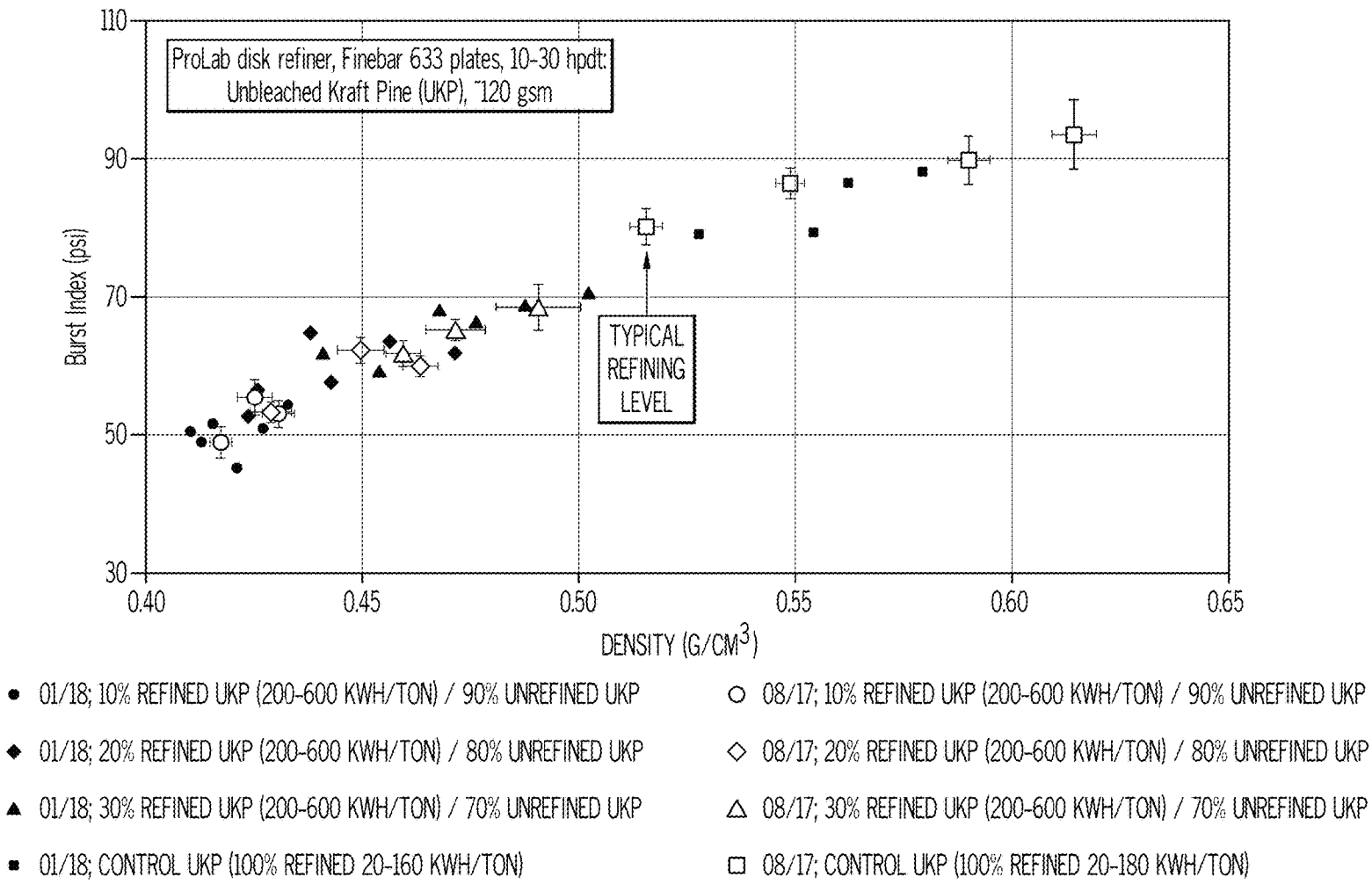
FIG. 7 is a graph showing a comparison of Burst Index, produced by conventional techniques (control UKP) and produced by the techniques of the present description.

FIG. 7 shows a comparison of Burst Index, produced by conventional techniques (control UKP) and produced by the techniques of the present description.

As shown in FIG. 7, Equivalent Burst Index (Burst normalized by basis weight) has been achieved at about 10% less density, where techniques of the present description resulted in a density of about 0.45-0.47 g/cm$^3$ with Burst Index within about 10% of conventionally refined paper board (at a density about 0.52 g/cm$^3$).

Figure 8:
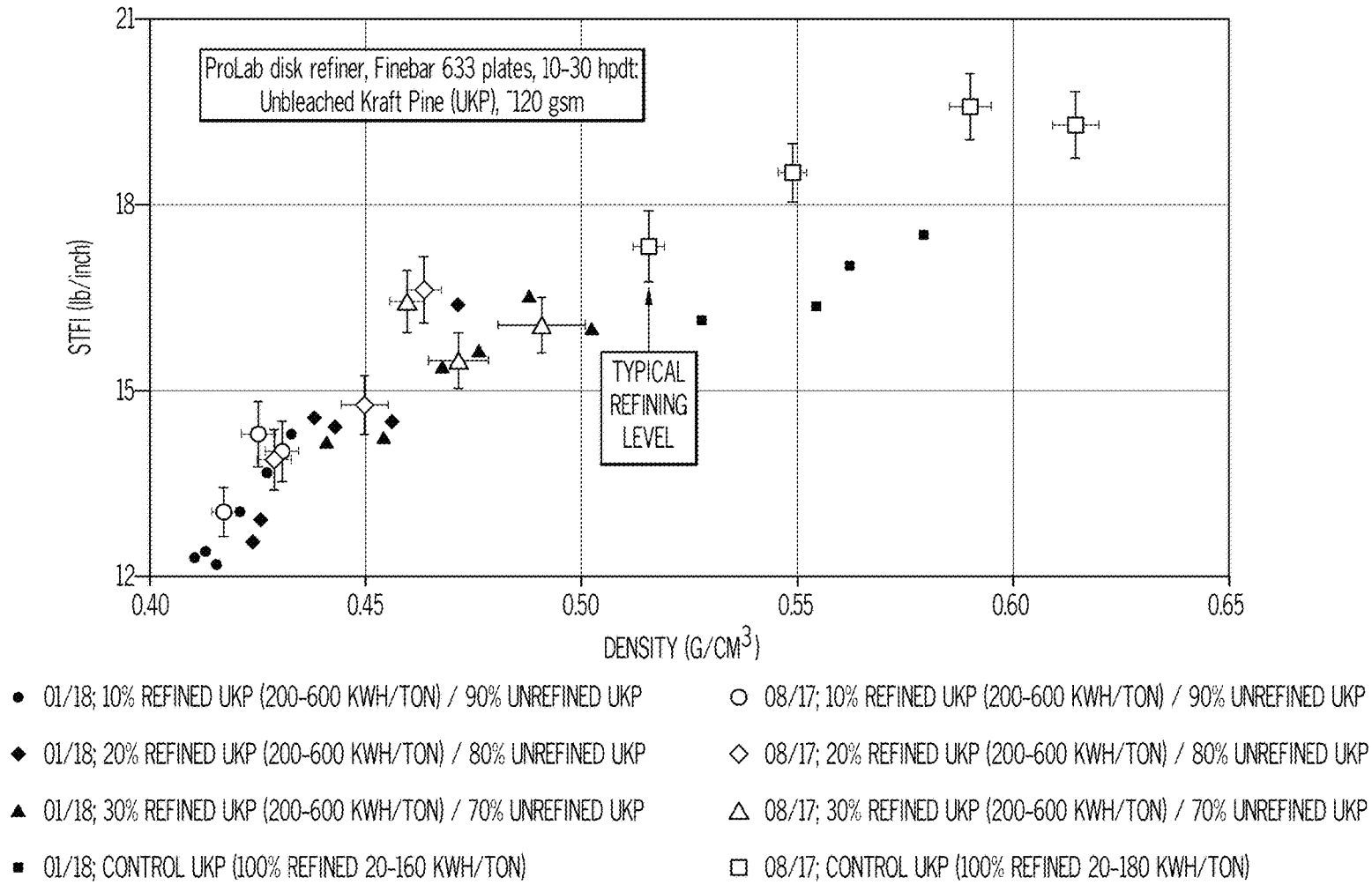
FIG. 8 is a graph showing a comparison of STFI, produced by conventional techniques (control UKP) and produced by the techniques of the present description.

FIG. 8 shows a comparison of STFI, produced by conventional techniques (control UKP) and produced by the techniques of the present description.

As shown by FIG. 8, Equivalent STFI has been achieved at about 10% less density, where techniques of the present description resulted in a density of about 0.45-0.47 g/cm$^3$ with STFI within about 10% of conventionally refined paper board (at a density about 0.52 g/cm$^3$).

Figure 9:
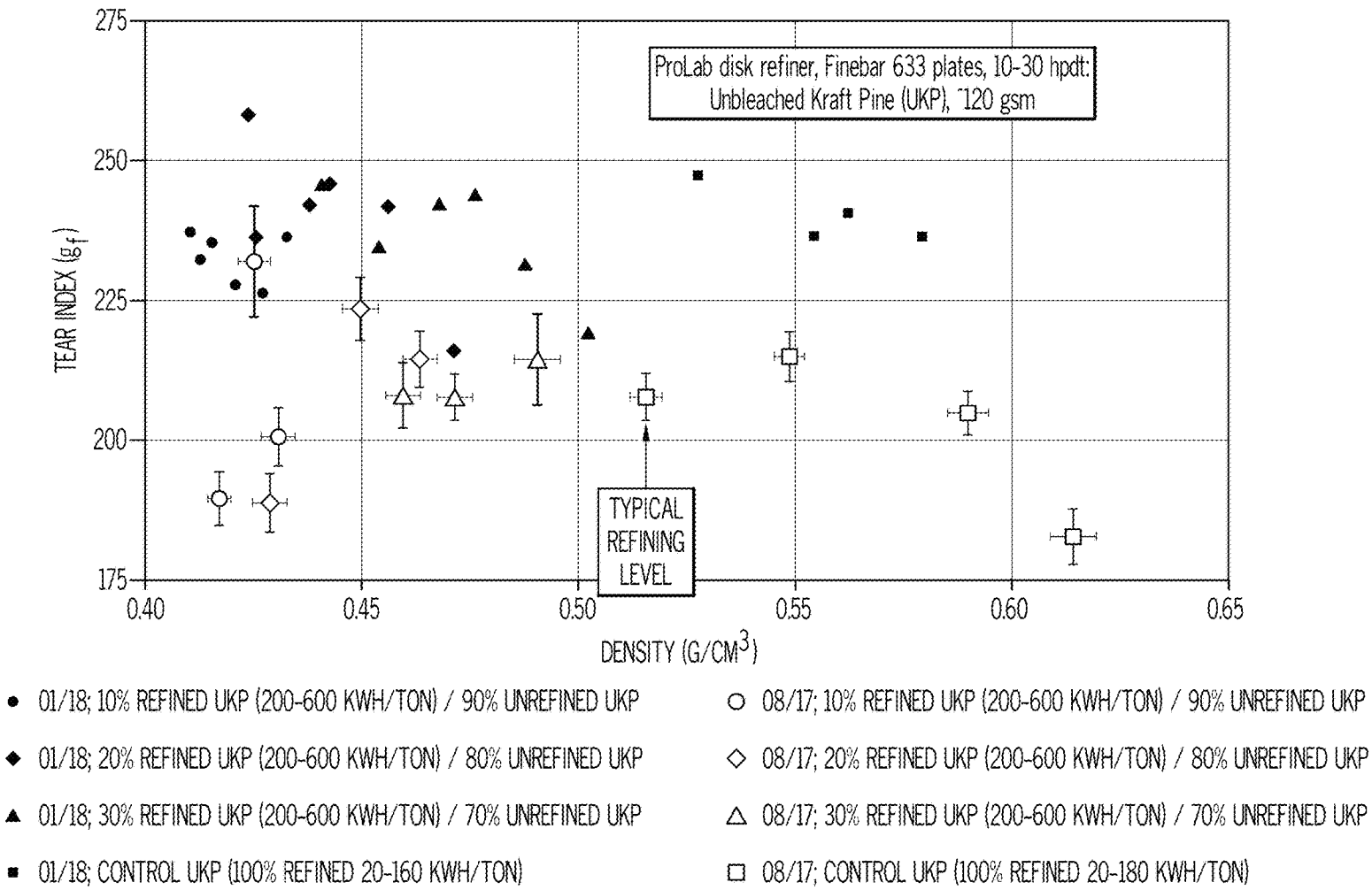
FIG. 9 is a graph showing a comparison of Tear Index, produced by conventional techniques (control UKP) and produced by the techniques of the present description.

FIG. 9 shows a comparison of Tear Index, produced by conventional techniques (control UKP) and produced by the techniques of the present description.

As shown in FIG. 9, Equivalent Tear Index (Tear normalized by basis weight) has been achieved at about 10% less density, where the techniques of the present description resulted in a density of about 0.45-0.47 g/cm$^3$ with Tear Index within about 10% of conventionally refined paper board (at a density about 0.52 g/cm$^3$).

Thus, the fiber blends of present description allow for effective sheet consolidation in paperboard manufacture with virgin kraft pine pulp at significantly lower densities than are possible with conventional refining, with low-density paperboard strength properties that are comparable to conventional paperboard By focusing refining treatment of a portion of the total amount of fibers, at refining levels that are significantly higher than typical and by combining the highly refined fibers with other fibers used substantially undamaged (without significant refining treatment), paperboard is manufactured to form a paper web of significantly reduced density with similar strength properties to conventionally formed sheets.

The papermaking furnish (i.e. the fiber blend) which results from the use of this selective refining has higher freeness (drains more easily) and lower water retention value (dries with less energy input) than conventional furnish potentially resulting in enhanced production capability for certain paper grades on existing machine assets. Additionally, paperboard can be made with selective refining at lower densities than are possible with conventional refining (because of the effective sheet consolidation with some highly refined pulp with bulky fiber matrix because of the interaction of the unrefined fibers present with the specially prepared, highly refined softwood fibers). Furthermore, paperboard strength properties with selective refining are similar to those achieved with conventional refining treatment The fiber blend of the present description may be used, for example, in the following commercial areas: packages for food and food service, packages for beverages, packages for consumer products, and liner board production This present description has, for example, the following advantages: better drainage for faster paper machine production, easier drying for faster paper machine production, effective sheet consolidation at lower density for product weight savings, tear strength remains as high as with conventional technology, sheet strength remains similar to that obtained with conventional technology.

Although various embodiments of the disclosed fiber blend, method for producing a fiber blend, and paperboard product including a fiber blend have been shown and described, modifications may occur to those skilled in the art upon reading the specification. The present application includes such modifications and is limited only by the scope of the claims.

What is claimed is:

1. A fiber blend comprising:

a first amount of wood pulp fibers refined in an amount of at least about 150 kWh per metric ton of gross refining energy, wherein the first amount of wood pulp fibers are characterized by extensive fiber damage; and a second amount of wood pulp fibers refined in an amount of at most about 10 kWh per metric ton of gross refining energy, wherein the second amount of wood pulp fibers are characterized by having little or no fiber damage, wherein the fiber blend is a mixture of the first amount of wood pulp fibers with the second amount of wood pulp fibers.

2. The fiber blend of claim 1 wherein the first amount of wood pulp fibers are included in an amount of at least about 5% by volume of the total volume of the fiber blend.

3. The fiber blend of claim 1 wherein the first amount of wood pulp fibers are included in an amount of at most about 40% by volume of the total volume of the fiber blend.

4. The fiber blend of claim 1 wherein the second amount of wood pulp fibers are included in an amount of at least about 60% by volume of the total volume of the fiber blend.

5. The fiber blend of claim 1 wherein the second amount of wood pulp fibers are included in an amount of at most about 95% by volume of the total volume of the fiber blend.

6. The fiber blend of claim 1 wherein the second amount of wood pulp fibers are unrefined.

7. The fiber blend of claim 1 wherein the first amount of wood pulp fibers includes at least one of hardwood fibers, softwood fibers, and recycled fibers.

8. The fiber blend of claim 1 wherein the second amount of wood pulp fibers includes at least one of hardwood fibers, softwood fibers, and recycled fibers.

9. The fiber blend of claim 1 wherein the first amount of wood pulp fibers is produced by chemical pulping.

10. The fiber blend of claim 1 wherein the second amount of wood pulp fibers is produced by chemical pulping.

11. The fiber blend of claim 1 wherein the first amount of wood pulp fibers and the second amount of wood pulp fibers consist essentially of unbleached wood pulp fibers.

12. A paperboard product comprising a fiber blend, the fiber blend comprising:

a first amount of wood pulp fibers refined in an amount of at least about 150 kWh per metric ton of gross refining energy, wherein the first amount of wood pulp fibers are characterized by having extensive fiber damage; and a second amount of wood pulp fibers refined in an amount of at most about 10 kWh per metric ton of gross refining energy, wherein the second amount of wood pulp fibers are characterized by having little or no damage, wherein the fiber blend is a mixture of the first amount of wood pulp fibers with the second amount of wood pulp fibers.

13. The paperboard product of claim 12 having a caliper thickness of about 8 to about 30 point.

14. The paperboard product of claim 12 wherein the paperboard product is included in at least one of a beverage board, a liner board, and a corrugated medium.

15. The paperboard product of claim 12 wherein the paperboard product is at least one layer of a multi-ply liner board that comprises an unbleached paperboard layer and a bleached paperboard layer.

16. The paperboard product of claim 12 wherein the first amount of wood pulp fibers are included in an amount of at least about 5% by volume of the total volume of the fiber blend.

17. The paperboard product of claim 12 wherein the first amount of wood pulp fibers are included in an amount of at most about 40% by volume of the total volume of the fiber blend.

18. The paperboard product of claim 12 wherein the second amount of wood pulp fibers are included in an amount of at least about 60% by volume of the total volume of the fiber blend.

19. The paperboard product of claim 12 wherein the second amount of wood pulp fibers are included in an amount of at most about 95% by volume of the total volume of the fiber blend.

20. The paperboard product of claim 12 wherein the second amount of wood pulp fibers are unrefined.

* * * * *